US009347734B2

(12) United States Patent
Cheng

(10) Patent No.: US 9,347,734 B2
(45) Date of Patent: May 24, 2016

(54) GEAR CHECKED CONSTRUCTION FOR TOY GUNS

(71) Applicant: KRISS Industries Asia LTD., Taipei (TW)

(72) Inventor: Li-Te Cheng, Taipei (TW)

(73) Assignee: KRISS INDUSTRIES ASIA LTD., Taipei (TW)

( * ) Notice: Subject to any disclaimer, the term of this patent is extended or adjusted under 35 U.S.C. 154(b) by 0 days.

(21) Appl. No.: 14/524,547

(22) Filed: Oct. 27, 2014

(65) Prior Publication Data

US 2016/0116248 A1 Apr. 28, 2016

(51) Int. Cl.

| | |
|---|---|
| ***F41B 11/00*** | (2013.01) |
| ***F41B 7/08*** | (2006.01) |
| ***F41B 11/57*** | (2013.01) |
| ***F41B 11/646*** | (2013.01) |

(52) U.S. Cl.
CPC . *F41B 7/08* (2013.01); *F41B 11/57* (2013.01); *F41B 11/646* (2013.01)

(58) Field of Classification Search
CPC ..... F41B 11/646; F41B 11/642; F41B 11/57; F41B 7/08
USPC ..... 124/31, 32, 66, 67; 446/473
See application file for complete search history.

(56) References Cited

U.S. PATENT DOCUMENTS 5,261,384 A * 11/1993 Hu ..... F41B 11/57 124/16
5,531,210 A * 7/1996 Meiser ..... F41B 11/642 124/66
6,564,788 B1 * 5/2003 Hu ..... F41B 7/003 124/31
7,077,117 B1 * 7/2006 Chu ..... F41B 7/08 124/31
7,100,592 B1 * 9/2006 Yang ..... F41B 7/00 124/67
7,841,329 B2 * 11/2010 Yang ..... F41B 11/57 124/66
7,946,283 B2 * 5/2011 Lee ..... F41B 11/646 124/67
7,963,281 B2 * 6/2011 Pong ..... F41B 11/646 124/65
7,975,682 B2 * 7/2011 Yang ..... F41B 11/642 124/64
8,091,542 B2 * 1/2012 Hu ..... F41B 11/57 124/77
8,146,577 B2 * 4/2012 Hu ..... F41B 11/57 124/32

(Continued)

FOREIGN PATENT DOCUMENTS

TW M332188 U 5/2008

*Primary Examiner* — Alexander Niconovich
(74) *Attorney, Agent, or Firm* — Locke Lord LLP; Tim Tingkang Xia, Esq.

(57) ABSTRACT

A gear checked construction for a toy gun comprises a gun body, a piston, a driving gear, and a check assembly. The piston is mounted inside the gun body and a rack is formed on the bottom of the piston. The driving gear engages with the rack to drive the piston and includes a clamping part. The check assembly comprises a hinge and a check bar. The hinge is mounted inside the gun body and the check bar is set around the hinge and comprises a forward part and a reverse part. The clamping part touches on the forward part and bursts through the check bar when the driving gear rotates in one direction to drive the piston, and the clamping part engages with the reverse part to stop the driving gear's rotation when the driving gear rotates in the other direction.

2 Claims, 6 Drawing Sheets

(56) References Cited

U.S. PATENT DOCUMENTS 8,297,269 B2 * 10/2012 Hu ..... F41B 11/57 124/32
8,302,589 B2 * 11/2012 Lee ..... F16H 1/04 124/66
8,662,063 B2 * 3/2014 Hu ..... F41B 11/57 124/32
8,800,541 B2 * 8/2014 Hu ..... F41A 33/06 124/32
9,121,660 B2 * 9/2015 Yang ..... F41B 11/646
2006/0231083 A1 * 10/2006 Tsurumoto ..... F41A 19/66 124/66
2007/0261689 A1 * 11/2007 Tai ..... F41B 11/646 124/67
2011/0214654 A1 * 9/2011 Lee ..... F16H 1/04 124/31
2015/0176942 A1 * 6/2015 Hu ..... F41B 11/71 124/32

* cited by examiner

GEAR CHECKED CONSTRUCTION FOR TOY GUNS

FIELD OF THE INVENTION

The invention relates to a toy gun, and more particularly to a gear checked construction for a toy gun.

BACKGROUND OF THE INVENTION

Taiwan patent TW-M332188 describes a toy gun spring release structure. The toy gun spring release structure has a piston with a spring and a release subgroup. The piston with spring has a row of notches in a rack on one exterior side. The notches in the rack connect with a driving gear of the toy gun. The release subgroup is connected between the toy gun casing and gears of the toy gun. The release subgroup includes a control part, a driving part, and a swivel arm. The control part is mounted at the toy gun exterior and is connected with the driving part at the toy gun interior. The driving part is also connected with the swivel arm. The swivel arm is also connected with the driving gear.

With the structure of the patent, mobilizing the driving part presses the swivel arm and releases the driving gear. The spring also releases its elastic force to make the piston move toward the front when the driving gear is released. Thus, elastic fatigue of the spring due to use is prevented.

With reference to FIGS. 1 and 2, although the patent can avoid elastic fatigue of the spring, the elastic force of the spring also makes the driving gear 1 reverse rotation. When the driving gear 1 reverses rotation too fast, the driving gear will hit the tail end of the piston 11 and damage the teeth and the piston 11.

In view of the foregoing, a need exists in the art for an improved toy gun construction. In addition, a need exists for such a gear checked construction to protect the toy gun construction and provide a longer service life for toy guns.

SUMMARY OF THE INVENTION

An objective of the present invention is to provide a gear checked construction for a toy gun. When the spring of the toy gun releases its elastic force, the gear checked construction can avoid breakage due to the driving gear hitting the tail end of the piston.

In order to accomplish the above objective and more, the present invention provides a gear checked construction for a toy gun. The gear checked construction for the toy gun comprises: a gun body; a piston mounted inside the gun body; a notched rack formed on the bottom of the piston; a driving gear engaged with the rack to drive the piston and comprises a clamping part; and a check assembly comprising a hinge and a check bar. The hinge is mounted inside the gun body and the check bar is set around the hinge and comprises a forward part and a reverse part. The clamping part touches on the forward part and bursts through the check bar when the driving gear rotates in one direction to drive the piston. Also, the clamping part engages with the reverse part to stop the driving gear's rotation when the driving gear rotates in the other direction.

In an embodiment of the present invention, the check assembly further comprises an elastic cell set around the hinge to allow the check bar to reset position in one direction.

In an embodiment of the present invention, the driving gear comprises at least one hole and the clamping part is a rod set inside the hole.

By the check assembly of the present invention, the clamping part touches on the forward part and bursts through the check bar when the driving gear rotates in one direction to drive the piston. And the clamping part engages with the reverse part to stop the driving gear's rotation when the driving gear rotates in the other direction. The gear checked construction of the present invention provides a protection mechanism to avoid breakage due to the driving gear hitting the tail end of the piston when the driving gear reverses rotation too fast.

DETAILED DESCRIPTION OF THE INVENTION

In order to describe details of the preferred embodiment of the present invention, description of the structure, and the application as well as the steps are made with reference to the accompanying drawings. It is learned that after the description, any variation, modification or the like to the structure and the steps of the embodiments of the preferred embodiment of the present invention is easily made available to any person skilled in the art. Thus, the following description is only for illustrative purpose and does not, in any way, try to limit the scope of the present invention.

Figure 1:
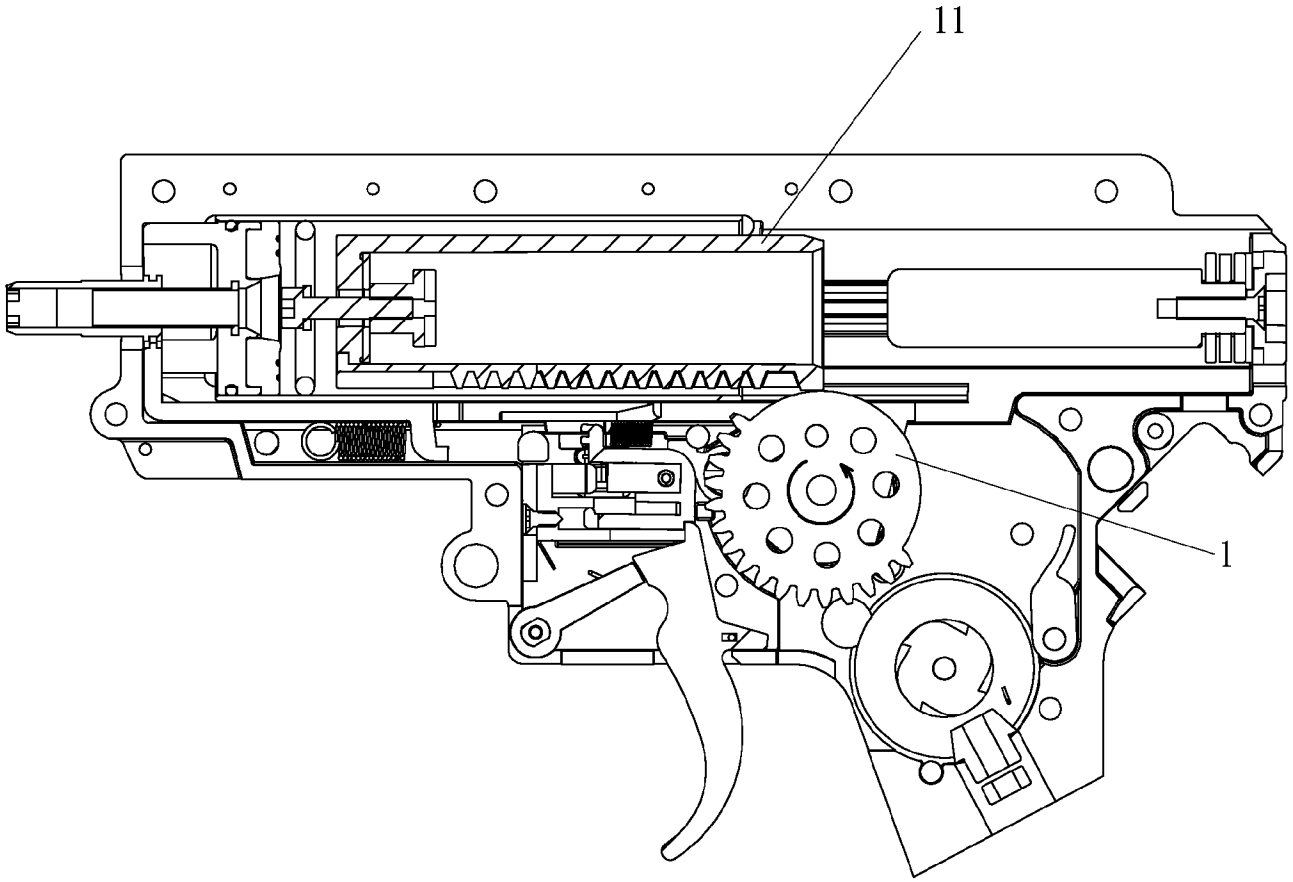
Fig. 1 (prior art)
FIG. 1 is a first perspective schematic view of the toy gun spring release structure of the prior art.
Figure 2:
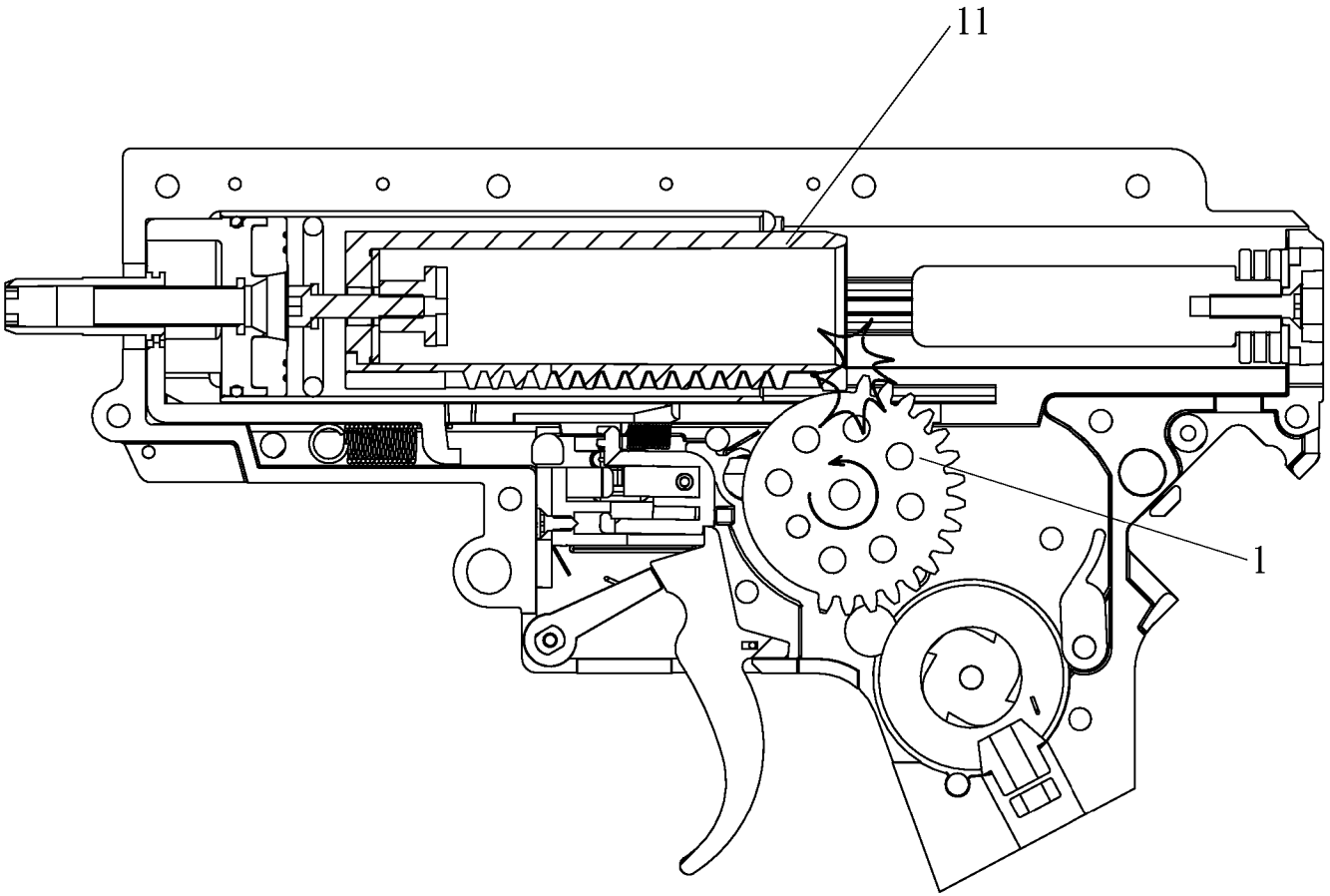
Fig. 2 (prior art)
FIG. 2 is a second perspective schematic view of the toy gun spring release structure of the prior art.
Figure 3:
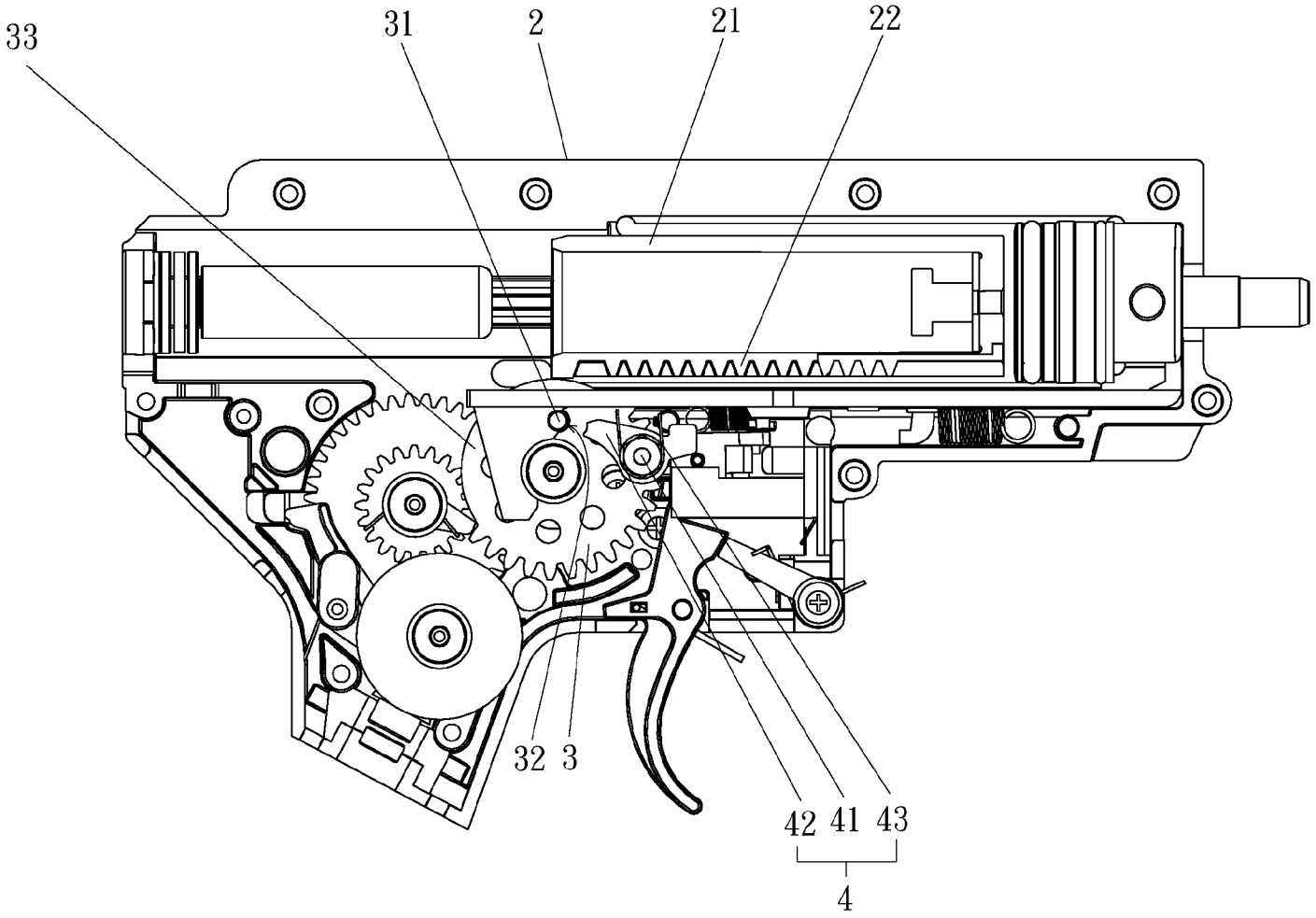
FIG. 3 is a preferred embodiment showing the toy gun construction of the present invention.
Figure 4A:
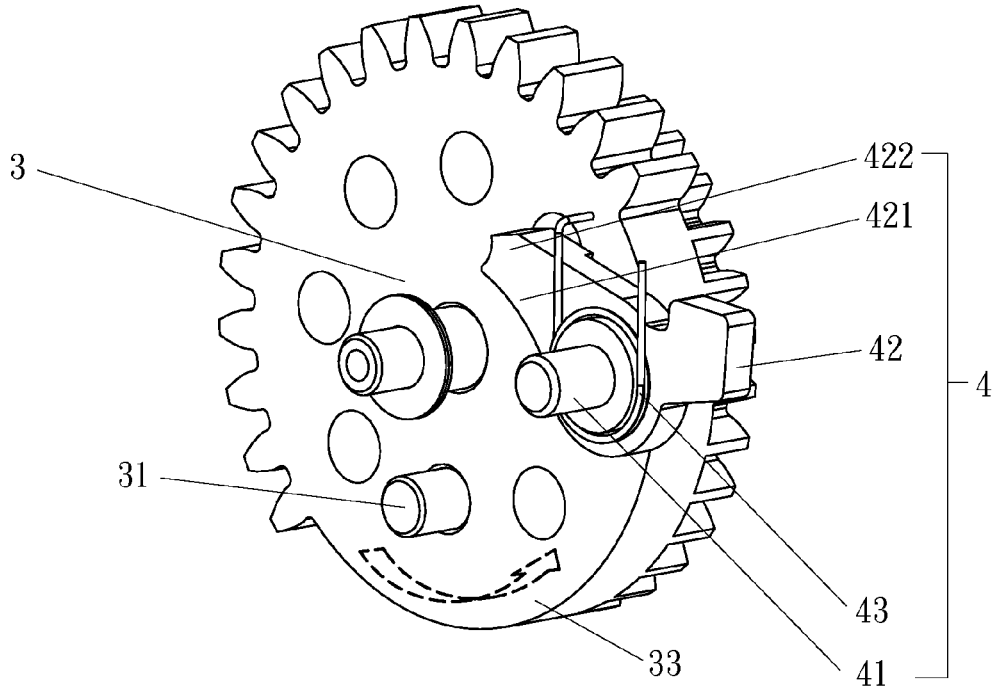
FIG. 4*a* is a first schematic view of the gear checked construction for the toy gun of the present invention.
Figure 4B:
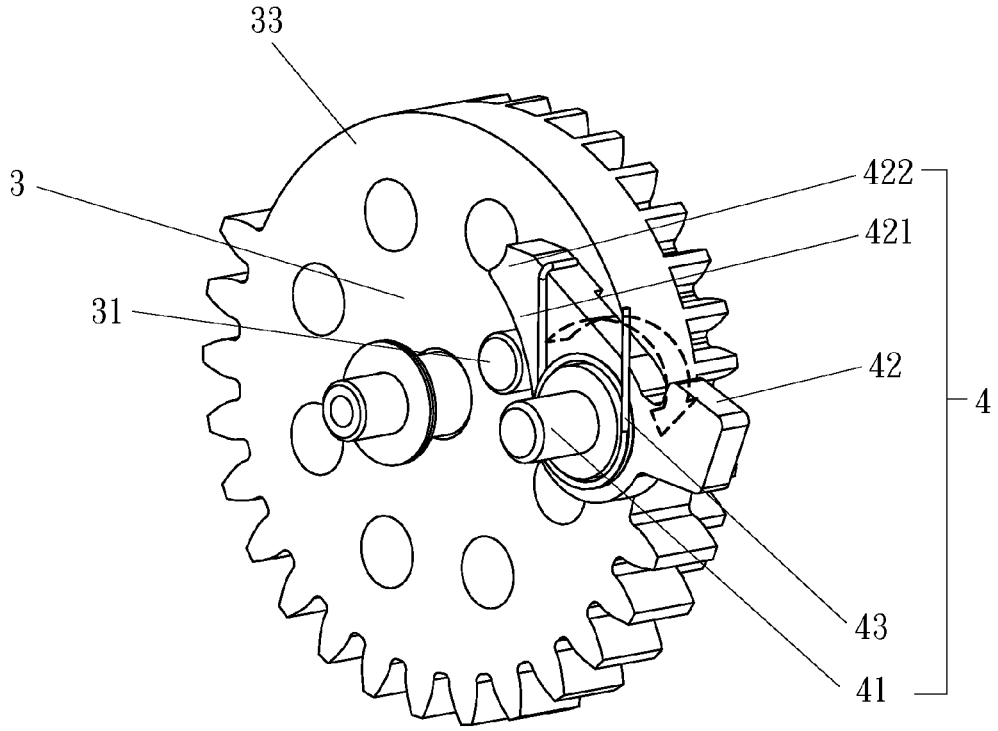
FIG. 4*b* is a second schematic view of the gear checked construction for the toy gun of the present invention.

With reference to FIGS. 3, 4*a*, and 4*b* of the preferred embodiment of the present invention, the gear checked construction for a toy gun comprises a gun body 2, a piston 21, a driving gear 3, and a check assembly 4.

The gun body 2 can be an automatic electric gun for players firing rubber bullets. The piston 21 is mounted inside the gun body 2 and a notched rack 22 is formed on the bottom of the piston 21. The piston 21 can reciprocate back and forth inside the gun body 2.

The driving gear 3 engages with the rack 22 to drive the piston 21. Preferably, the driving gear 3 comprises at least one hole 32, a clamping part 31 that is a rod set inside the hole 32, and a non-toothed part 33. The driving gear 3 engages with the rack 22 to drive the piston 21 when the driving gear 3 rotates, and uses the non-toothed part 33 to make the piston 21 reciprocate back and forth inside the gun body 2.

The check assembly 4 comprises a hinge 41 and a check bar 42. The hinge 41 is mounted inside the gun body 2. The check bar 42 is set around the hinge 41 and comprises a forward part 421 and a reverse part 422. Preferably, the forward part 421 is a curved shape and the reverse part 422 is a groove. The check assembly 4 further comprises an elastic cell 43, for example, a spring. The elastic cell 43 is positioned around the hinge 41 and allows the check bar 42 to reset position in one direction.

Accordingly, with the gear check construction of the toy gun as described the operation of the device will be readily understood. With reference to FIGS. 3, 4*a*, and 4*b*, the driving gear 3 has a non-toothed part 33. The driving gear 3 engages with the rack 22 to drive the piston 21 when the driving gear 3 rotates, and uses the non-toothed part 33 to make the piston 21 reciprocate back and forth inside the gun body 2. Meanwhile, the clamping part 31 touches on the forward part 421 and burst through the check bar 42 when the driving gear 3 rotates in one direction to drive the piston 21. Therefore, the toy gun can fire rubber bullets.

Figure 5A:
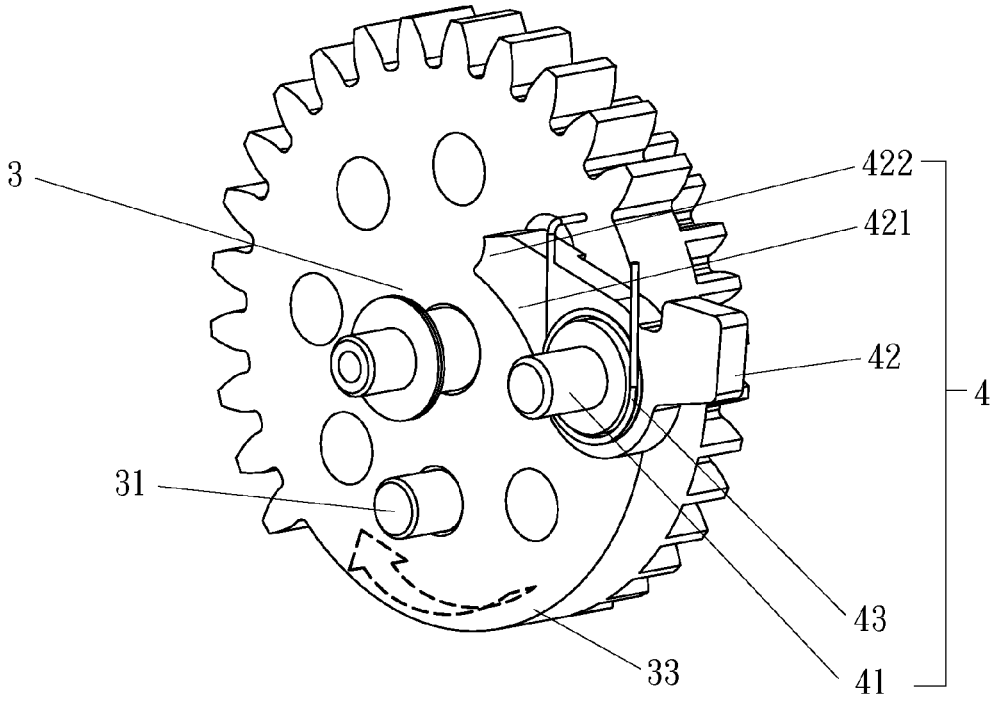
FIG. 5*a* is a third schematic view of the gear checked construction for the toy gun of the present invention.
Figure 5B:
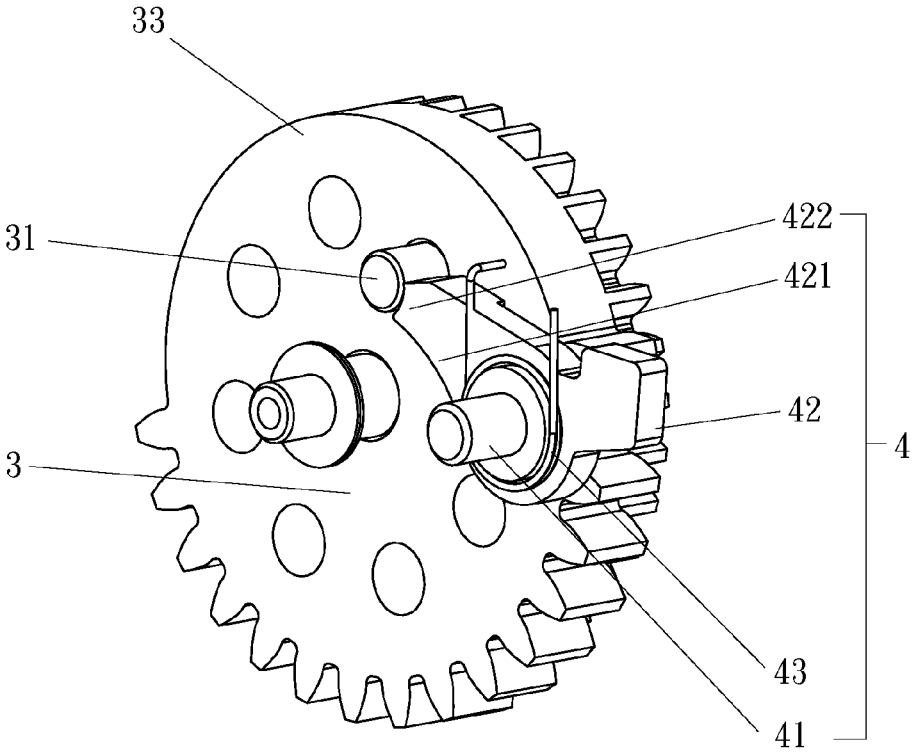
FIG. 5*b* is a forth schematic view of the gear checked construction for the toy gun of the present invention.

With reference to FIGS. 3, 5*a*, and 5*b*, when the player releases the driving gear 3, a spring of the toy gun also releases elastic force to make the piston 21 move toward the front. Thus, elastic fatigue of the spring due to hard use is avoided. Meanwhile, the elastic force of the spring also makes the driving gear 3 reverse rotation. The clamping part 31 engages with the reverse part 422 to stop the rotation of the driving gear 3 when the driving gear 3 rotates in the other direction.

Figure 6:
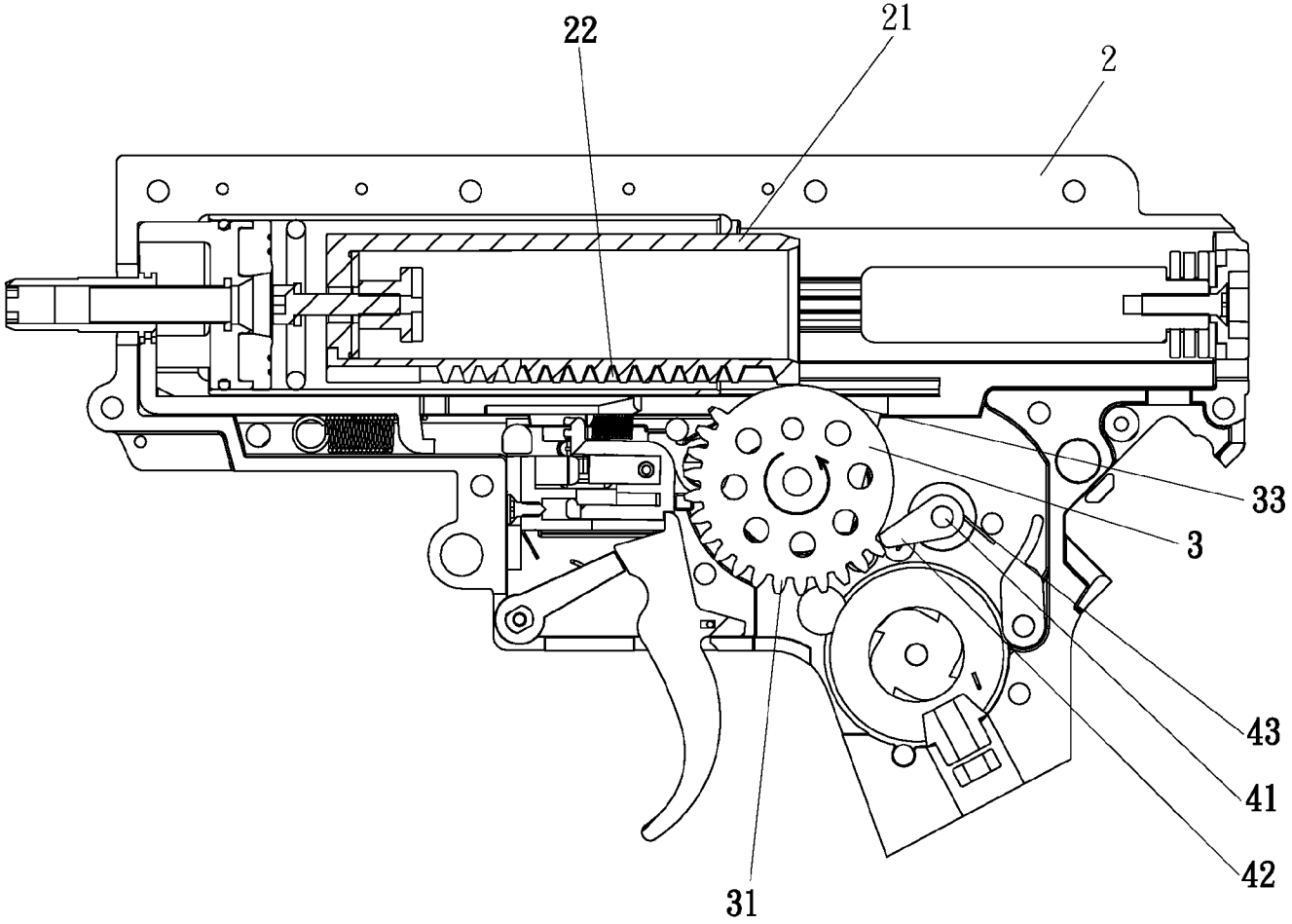
FIG. 6 is another embodiment showing the toy gun construction of the present invention.

With reference to FIG. 6 that illustrates another embodiment of the present invention, wherein the hinge 41, the check bar 42, and the elastic cell 43 can be set as shown in FIG. 6, but not limited to. The function is the same as the previous embodiment. In this embodiment, the clamping part 31 of the driving gear 3 is the driving gear's teeth. The clamping part 31 engages with the check bar 42 to stop the rotation of the driving gear 3 when the elastic force of the spring makes the driving gear 3 reverse rotation.

Therefore, the design of the toy gun construction is non-obvious and sufficiently inventive, and reflects a same general patentability requirement. It is noted that the present invention has the advantages that the invention provides a gear checked construction for a toy gun. Breakage of the driving gear 3 due to hitting the tail end of the piston 21 when the spring releases elastic force is prevented.

While the invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A gear checked construction for a toy gun, comprising:

a gun body;

a piston, mounted inside the gun body, a rack formed on a bottom of the piston;

a driving gear, engaging with the rack to drive the piston, the driving gear comprising a clamping part, the clamping part being a cylinder; and a check assembly, comprising a hinge, a check bar and an elastic cell, wherein the hinge is mounted inside the gun body, the check bar is set around the hinge and comprises a forward part and a reverse part, the reverse part being a groove corresponding to the cylinder, and the elastic cell is positioned around the hinge and allows the check bar to reset position in one direction;

wherein the clamping part touches on the forward part and bursts through the check bar when the driving gear rotates in one direction to drive the piston, and the clamping part engages with the reverse part to stop rotation of the driving gear when the driving gear rotates in an opposite direction.

2. The gear checked construction for the toy gun as claimed in claim 1, wherein the driving gear comprises at least one hole, and the clamping part is a rod set inside the at least one hole.

* * * * *